United States Patent [19]

Ramaswamy

[11] Patent Number: 5,015,311

[45] Date of Patent: May 14, 1991

[54] PRIMARY/DETONATOR COMPOSITIONS SUITABLE FOR USE IN COPPER CUPS

[75] Inventor: Coodly P. Ramaswamy, Christiana, Pa.

[73] Assignee: Breed Automotive Technology, Inc., Boonton Township, Morris County, N.J.

[21] Appl. No.: 593,906

[22] Filed: Oct. 3, 1990

[51] Int. Cl.[5] ..... C06B 33/06

[52] U.S. Cl. ..... 149/42; 149/77; 149/82

[58] Field of Search ..... 149/42, 77, 82

[56] References Cited

U.S. PATENT DOCUMENTS

| | | | |
|---|---|---|---|
| 3,904,451 | 9/1975 | Rainone | 149/85 |
| 4,566,921 | 1/1986 | Duguet | 149/77 |
| 4,963,201 | 10/1990 | Bjerke et al. | 149/2 |
| 4,994,125 | 2/1991 | Mei | 149/22 |

*Primary Examiner*—Stephen J. Lechert, Jr.

*Attorney, Agent, or Firm*—Kane, Dalsimer, Sullivan, Kurucz, Levy, Eisele and Richard

[57] ABSTRACT

The invention is directed to a primary/detonator composition suitable for use in an automobile airbag system. The composition may safely be housed in a copper support structure (a/k/a cups).

4 Claims, No Drawings

PRIMARY/DETONATOR COMPOSITIONS SUITABLE FOR USE IN COPPER CUPS

FIELD OF THE INVENTION

The invention is directed to a primary/detonator composition suitable for use in an automobile airbag system. The composition may safely be housed in a copper support structure (a/k/a cups).

BACKGROUND OF THE INVENTION

Primers, or detonators as they are alternatively known, are the means used to detonate an explosive charge. Those devices may be detonated by electrical or mechanical means. They are comprised of a primary explosive which may be initiated by stab, friction or impact, an intermediate explosive composition that is set off by the primer composition, and a base charge of a secondary explosive such as RDX or HMX to provide the desired explosive output. These primers are ordinarily coupled with booster charges and a propellant to form an explodable ignition chain.

Primer/detonator compositions are employed in a variety of applications, including weapon systems, razing buildings, and in creating excavations. Primer/-detonators are also used to initiate the explosive chain in automobile air bag systems. Explosive charges are uniquely suited for these systems because the explosive reaction instantaneously generates a large volume of gas that fills the air bag. It is essential that the air bag be filled within that instant between collision and the occupant's impact with the dashboard.

As the primer/detonator functions to initiate the explosive reaction, the primer must be capable of being set-off by the energy provided by the crash. This is acheived by using mechanical or chemical sensitizers in the primer composition used in the primer. Since the energy provided is of a low order, mechanical sensitizers are unable to set-off the primer composition. Chemical sensitizers are capable of great sensitivity so that the primer compositions are set off at low impact energy. The sensitizer must also be capable of not being desensitized at temperatures higher than 95° C. Therefore sensitizers like tetrazene are not useful, which decompose at temperatures as low as 80° C.

Airbag systems are ordinarily housed in a metallic structure. Copper is a favored material for housing the primer as it is lightweight and capable of withstanding the explosive forces generated during detonation.

SUMMARY OF THE INVENTION

It is an object of the invention to provide primer/-detonator compositions compatible for use with copper cups.

It is a further object of the invention to develop chemical sensitizers which are an alternative to tetracene.

The present invention discloses two primer/detonator compositions compatible for use in a copper cup. The compositions are comprised of antimony sulfide, potassium chlorate, zirconium, and utilize either lead ferrocyanide or lead thiocyanate as the sensitizer. It is notable that lead ferrocyanide has never been utilized in primer compositions as a sensitizer.

The following composition is disclosed and can be safely used within a copper cup:

| | % |
|---|---|
| Antimony Sulfide | 55.5 |
| Potassium Chlorate | 37.5 |
| Zirconium | 2.0 |
| Lead Ferrocyanide | 5.0 |

Lead ferrocyanide used herein as a chemical sensitizer, has never been used in this capacity.

A second formulation suitable for use with a copper cup makes use of lead thiocyanate as the sensitizer is set forth below.

| | % |
|---|---|
| Antimony Sulfide | 55.5 |
| Potassium Chlorate | 37.5 |
| Zirconium | 2.0 |
| Lead Thiocyanate | 5.0 |

I claim:

1. A primer/detonator composition housed in a copper cup comprised of the following: antimony sulfide, potassium chlorate, zirconium and lead ferrocyanide.

2. A primer/detonator as set forth in claim 1 wherein the following compositions are utilized:

| | % |
|---|---|
| Antimony Sulfide | 55.5 |
| Potassium Chlorate | 37.5 |
| Zirconium | 2.0 |
| Lead Ferrocyanide | 5.0 |

3. A primer/detonator composition housed in a copper cup comprised of antimony sulfide, potassium chlorate, zirconium and lead thiocyanate.

4. A primer/detonator as set forth in claim 3 wherein the components comprise the following compositions:

| | % |
|---|---|
| Antimony Sulfide | 55.5 |
| Potassium Chlorate | 37.5 |
| Zirconium | 2.0 |
| Lead Thiocyanate | 5.0 |

* * * * *